US008995861B2

(12) United States Patent
Kitamura et al.

(10) Patent No.: US 8,995,861 B2
(45) Date of Patent: Mar. 31, 2015

(54) IMAGE FORMING APPARATUS

(75) Inventors: Takuya Kitamura, Numazu (JP); Hideo Kihara, Suntou-gun (JP); Yuji Kawaguchi, Mishima (JP); Kouki Yano, Kawasaki (JP); Yuta Isobe, Susono (JP)

(73) Assignee: Canon Kabushiki Kaisha, Tokyo (JP)

( * ) Notice: Subject to any disclaimer, the term of this patent is extended or adjusted under 35 U.S.C. 154(b) by 128 days.

(21) Appl. No.: 13/211,976

(22) Filed: Aug. 17, 2011

(65) Prior Publication Data

US 2012/0045229 A1 Feb. 23, 2012

(30) Foreign Application Priority Data

Aug. 20, 2010 (JP) ..... 2010-185090
Aug. 20, 2010 (JP) ..... 2010-185294

(51) Int. Cl.
*G03G 15/00* (2006.01)
*G03G 21/00* (2006.01)

(52) U.S. Cl.
CPC ..... *G03G 21/0047* (2013.01)
USPC ..... 399/71; 399/99; 399/343

(58) Field of Classification Search
USPC ..... 399/44, 71, 99, 343, 354
See application file for complete search history.

(56) References Cited

U.S. PATENT DOCUMENTS

| | | | | |
|---|---|---|---|---|
| 6,405,015 | B1 | 6/2002 | Suzuki | |
| 2007/0127944 | A1 * | 6/2007 | Mochizuki | 399/101 |
| 2008/0089726 | A1 * | 4/2008 | Hatakeyama et al. | 399/346 |
| 2008/0317502 | A1 * | 12/2008 | Jeong et al. | 399/130 |
| 2009/0169223 | A1 * | 7/2009 | Yamaki | 399/43 |

FOREIGN PATENT DOCUMENTS

| | | | | |
|---|---|---|---|---|
| CN | 101008813 A | | 8/2007 | |
| JP | 09-062161A A | | 3/1997 | |
| JP | 09062161 A | * | 3/1997 | G03G 21/10 |
| JP | 2004-069814 A | | 3/2004 | |
| JP | 2008-090234 A | | 4/2008 | |
| JP | 2010-014943 A | | 1/2010 | |

OTHER PUBLICATIONS

JP 09062161 English translation, Aoyonagi et al., Mar. 1997.*

* cited by examiner

*Primary Examiner* — David Gray
*Assistant Examiner* — Thomas Giampaolo, II
(74) *Attorney, Agent, or Firm* — Canon USA Inc. IP Division

(57) ABSTRACT

In an image forming apparatus, when no image is being formed, an image bearing member is rotated at least one rotation, in a state in which a transfer bias is controlled such that a potential on a surface of the image bearing member on the upstream side in the rotational direction of a cleaning apparatus is a polarity opposite to that of a developer.

13 Claims, 9 Drawing Sheets

IMAGE FORMING APPARATUS

BACKGROUND OF THE INVENTION

1. Field of the Invention

The present invention relates to an image forming apparatus employing an electrophotographic method or an electrostatic recording method, such as a copying machine or a printer.

2. Description of the Related Art

Conventionally, there are known a number of electrophotographic methods. Generally speaking, the electrophotographic method forms an electrostatic latent image on an image bearing member with a photoconductive substance by using various units. Subsequently, the electrostatic latent image is turned into a toner image by a developing apparatus, and the toner image is transferred to a transfer material such as paper as needed. Then, the toner image is fixed to the transfer material by heat, pressure, etc. to thereby obtain a copy. In addition, the residual toner image on the image bearing member is recovered by a cleaning member.

Regarding the cleaning member, blade cleaning, fur brush cleaning, or roller cleaning are widely used. However, in all of these cleaning methods, the residual toner is either mechanically scraped off or intercepted to be gathered in a waste toner container.

In a method in which mechanical cleaning is thus performed, it can happen that some external additive released from the toner surface due to fluctuations in torque during the rotation and drive of the image bearing member may enter the interior of a contact nip between the cleaning member and the image bearing member. The external additive entering into the interior of the nip adheres to the surface of the image bearing member by the pressure of the cleaning member applied thereto. Once something adheres to the surface of the image bearing member, the adhering substance cannot be scraped off by the cleaning member but may pass while pushing up the cleaning member. If the cleaning member is pushed up, the cleaning performance may declines and an issue (defective cleaning) may occur in which the recovered transfer residual toner is drawn to be allowed to pass.

To cope with this issue, U.S. Pat. No. 6,405,015 discusses the use of a cleaning blade as the cleaning member which exhibits a value of 200 kgf/cm$^2$ or more in a tensile stress test at extension of 300%. Thus, there is discussed a technique capable of suppressing defective cleaning and adhesion of toner or an external additive to the image bearing member by the use of the cleaning blade.

Japanese Patent Application Laid-Open No. 2004-069814 discusses a technique in which a discharge device is provided on the upstream side in the photosensitive-member rotational direction of the cleaning device and in which the surface potential of the image bearing member is varied within a range of 0±200 V, so that cleaning property for the residual toner and silica, which serves as the external additive can be improved.

However, due to the recent increase in the speed and service life of printers, copying machines or the like and the variety in the environments in which they are used, the opportunity for the image bearing member to be worn by the cleaning member tends to increase. The cleaning member is rubbed against the image bearing member, and minute asperity is generated on the surface of the image bearing member, which leads to deterioration in the cleaning performance. In particular, the external additive released from the toner surface is not easily removed by cleaning due to its smaller particle size as compared with that of the toner. Thus, when there exists such asperity on the surface of the image bearing member, the external additive is allowed to pass by the cleaning member to come to exist on the surface of the image bearing member as an adhering substance.

A region having such an adhering substance may cause an issue of defective cleaning, in which the toner is allowed to pass the region, due to poor contact between the cleaning member and the image bearing member. When the defective cleaning occurs, the toner which has been allowed to pass appears on the next image to be formed, thus generating an image defect. In the case where a contact development method is adopted, the toner on the development roller may adhere to the adhering substance at the developing position, so that there is the possibility of the adhering toner being output as an image defect in the form of black dots. Thus, the technique discussed in U.S. Pat. No. 6,405,015 may not be capable of performing complete cleaning on the asperity due to wear of the image bearing member surface while it is effective for a flat image bearing member because of the improvement in the cleaning performance of the cleaning blade.

According to the technique discussed in Japanese Patent Application Laid-Open No. 2004-069814, the surface potential of the image bearing member is varied in a range of 0±200 V to thereby improving the cleaning performance. However, the technique of Japanese Patent Application Laid-Open No. 2004-096814 is directed to an improvement in the cleaning efficiency for silica, and the removal of an adhering substance other than silica through cleaning is not taken into account.

SUMMARY OF THE INVENTION

The present invention is directed to a technique for realizing a high quality print output free from defective cleaning attributable to an adhering substance on an image bearing member surface or black dots as a defect on an image.

According to an aspect of the present invention, an image forming apparatus includes an image bearing member configured to be rotatable and to bear a latent image, a developing apparatus configured to develop the latent image into a toner image by using a toner containing an external additive, a transfer apparatus configured to transfer the toner image to a member to be transferred, a cleaning apparatus configured to perform cleaning of the toner from the image bearing member after transfer, and a control apparatus configured to charge the image bearing member situated on an upstream side in a rotational direction of the image bearing member with respect to the cleaning apparatus to a predetermined polarity during an image-formation period, the control apparatus charges the image bearing member to a polarity opposite to the predetermined polarity during a non-image-formation period, and to execute a cleaning mode in which the image bearing member is rotated one rotation or more so that a surface of the image bearing member charged to the opposite polarity may pass the cleaning apparatus.

Further features and aspects of the present invention will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the invention and, together with the description, serve to explain the principles of the invention.

DESCRIPTION OF THE EMBODIMENTS

Various exemplary embodiments, features, and aspects of the invention will be described in detail below with reference to the drawings.

Figure 1:
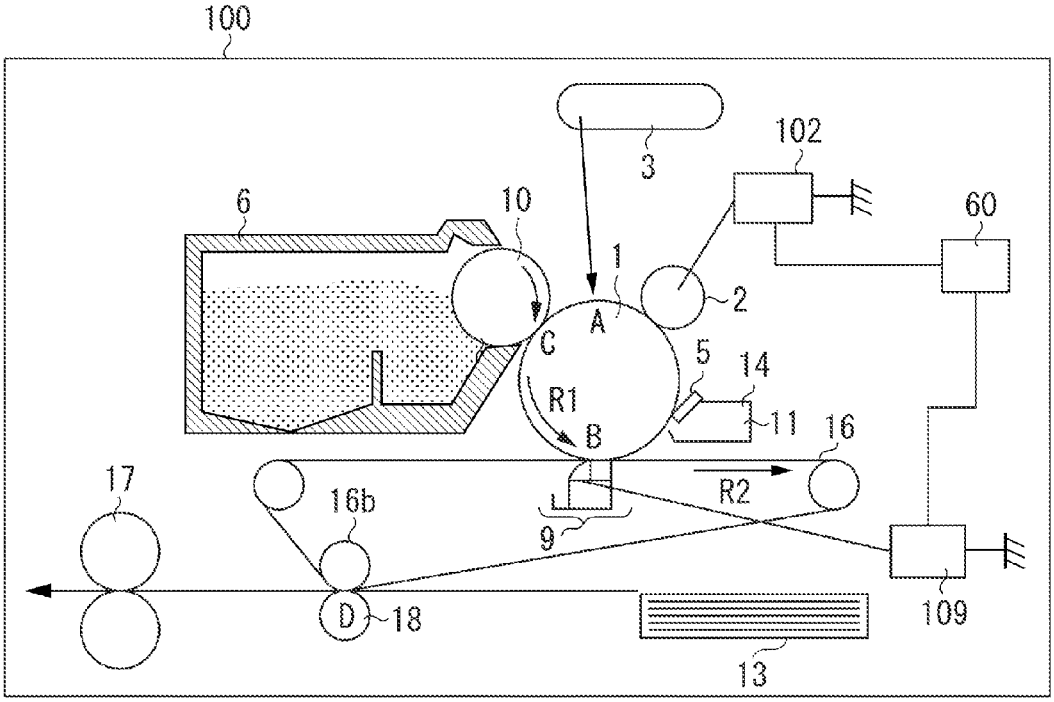
FIG. 1 is a schematic sectional view of an image forming apparatus according to a first exemplary embodiment to which the present invention is applicable.

Referring to FIG. 1, an image forming apparatus 100 according to a first exemplary embodiment of the present invention will be described. The dimensions, materials, shapes, positional relationship, etc. of the components of the present exemplary embodiment described below are to be modified as appropriate according to the configuration of the apparatus to which the present invention is applied and various conditions, and they should not be construed restrictively.

FIG. 1 illustrates the configuration of an image forming apparatus according the present exemplary embodiment. A photosensitive drum 1 serving as an image bearing member is provided to be rotatable and can rotate in the direction of an arrow R1. The image forming apparatus includes a charging roller 2. An exposure apparatus 3 is arranged such that a laser beam emitted therefrom reaches an exposure position A on the photosensitive drum 1.

A developing apparatus 6 contains a toner of negative polarity, and includes a development roller 10 serving as a developer carrying member. Development is effected at a developing position C, where the development roller 10 faces to and comes in contact with the photosensitive drum 1.

Under the photosensitive drum 1, there is provided a transfer belt 16 serving as an intermediate transfer member (a member to be transferred) extending on a plurality of rollers so as to rotate in the direction R2 in FIG. 1. A primary transfer device 9 is arranged within the transfer belt 16 at a primary transfer position B, where the photosensitive drum 1 and the transfer belt 16 are pressed against and brought into contact with each other.

The transfer device 9 is brought into contact with the transfer belt 16 from the inner side, and is equipped with a transfer sheet for transferring a toner image on the photosensitive drum 1 to the transfer belt 16 through application of voltage. At the position of a roller 16*b*, which is one of the rollers around which the transfer belt 16 is stretched, a secondary transfer roller 18 is arranged so as to pinch the transfer belt 16 between the roller 16*b*. At a secondary transfer position D, the image is transferred onto a transfer material 13, such as a sheet, that is conveyed thereto. After the transfer, the transfer material 13 is conveyed to a fixing device 17.

On the downstream side in the moving direction of the photosensitive drum 1 with respect to the primary transfer position B, a photosensitive member cleaning apparatus 11 is installed. The photosensitive member cleaning apparatus is equipped with a blade 5 brought into contact with the photosensitive drum 1 so as to be able to scrape off the toner on the photosensitive drum 1. After the cleaning, the photosensitive drum 1 is charged again by the charging roller 2.

The operation of the image forming apparatus during image formation will be described. Here, the image formation refers to a period in which operations such as charging, exposure, development, and transfer are performed in order to form an image on a recording sheet. The photosensitive drum 1 rotates in the direction of the arrow R1 at a speed of approximately 100 mm/sec, and the surface thereof is uniformly charged by the charging roller 2 to a predetermined potential of the same polarity as the toner (negative polarity). At the exposure position A, an electrostatic latent image is formed on the photosensitive drum 1 by a laser beam emitted from the exposure apparatus 3 in accordance with an image signal. The electrostatic latent image thus formed is developed at the developing position C by the developing apparatus 6 to form a toner image. The toner image formed on the photosensitive drum 1 is transferred onto the intermediate transfer belt 16 at the primary transfer position B.

More specifically, a voltage of approximately −1100 V is applied to the charging roller 2 to charge the photosensitive drum 1 to approximately −530 V. The exposure apparatus 3 exposes the photosensitive drum 1 to light according to the image signal to form an electrostatic latent image on the photosensitive drum 1. The developing apparatus 6 causes a toner of negative polarity to adhere to the exposed portion and performs reversal development to turn the electrostatic latent image into a toner image. A voltage of approximately +450 V is applied to the transfer device 9 to transfer the toner image to the intermediate transfer belt 16. The potential on the photosensitive drum 1 after the transfer is approximately −210 V under the influence of the voltage due to the transfer device 9.

An external additive is added to the toner used in the present exemplary embodiment. More specifically, the external additive contains silica, which is used for the purpose of imparting fluidity to the toner, and titanium oxide, which is used for the purpose of making the toner charging amount uniform.

The cleaning apparatus 11 according to the present exemplary embodiment is a blade type apparatus using an elastic cleaning blade 5 as a cleaning member, which is formed of a urethane rubber tip blade and sheet metal. The blade 5 is disposed to bring its leading edge into contact with the photosensitive drum 1, with facing the counter direction to the rotational direction of the drum 1 (the image bearing member rotational direction). Transfer residual toner on the drum surface is scraped off by the blade 5 and is stored in a waste toner chamber (waste toner container).

As described above, in the present exemplary embodiment also, the requirements for the long service life, the increase in speed, and the adaptability to various environments of use are met, so that the photosensitive drum 1 is worn out by the blade 5 and fine asperity flaws grow on the image bearing member surface in the rotational direction of the photosensitive drum. Due to the asperity flaws, there is the possibility of the cleaning performance deteriorating and an adhering substance being generated. It has been found out that the adhering substance cannot be scraped off satisfactorily by the blade 5 during image formation.

Examination by the inventors has made it clear that the cleaning property of the adhering substance is related to the potential of the portion of the photosensitive drum 1 immediately before the blade. This reason will be described below.

Figure 2:
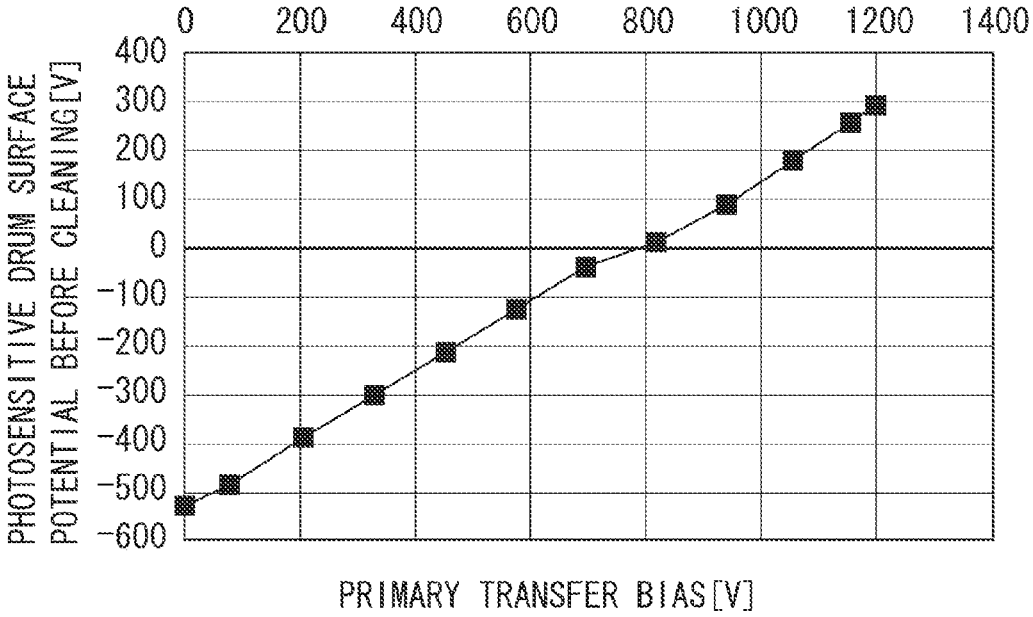
FIG. 2 illustrates the relationship between primary transfer bias and potential before cleaning in the first exemplary embodiment.

FIG. 2 illustrates the relationship between the primary transfer bias and the surface potential (potential before cleaning) of the portion of the photosensitive drum 1 on the upstream side in the rotational direction of the photosensitive drum 1 of the blade 5 when the transfer bias from a primary transfer power source 109 is varied in the state in which the charging bias equivalent to that in the image formation is applied thereto. When the absolute value of the transfer bias is increased from 0 V in a polarity (positive polarity) opposite to that of the toner, the potential before cleaning is reversed from the same polarity as that of the toner to the opposite polarity.

Next, a photosensitive drum having approximately the same number of adhering substances was prepared, and the photosensitive drum was examined for a change in the cleaning property of the adhering substances by varying the potential before cleaning.

Image formation was performed repeatedly on a predetermined number of sheets to generate adhering substances on the photosensitive drum 1. In a condition in which the number of adhering substances adhering to the photosensitive drum 1 was substantially the same, the potential before cleaning was set to an arbitrary value by varying the primary transfer bias under the same condition as that of FIG. 2. Under this condition, the adhesion level on the photosensitive drum 1 after 10 revolutions and 30 revolutions thereof were checked to obtain the results as given in Table 1. A case where there was no change in adhesion level is indicated by the symbol of cross (x), and a case where an improvement in terms of adhesion level is to be observed is indicated by the symbol of circle (○).

At this time, the developing apparatus 6 and the photosensitive drum 1 are in a non-contact state. From these results, it has been found out that in the case where the polarity before cleaning is the same as that of the toner (negative polarity), there is no change in the adhesion level of the adhering substances, which have not been recovered by the blade 5. On the other hand, in the case where the polarity before cleaning is opposite to that of the toner (positive polarity), the adhering substances are recovered by the blade 5, with the amount of the adhering substances on the photosensitive drum 1 being reduced.

TABLE 1

| | Primary transfer bias | | | | | | | | |
|---|---|---|---|---|---|---|---|---|---|
| | 205 | 452 | 574 | 695 | 815 | 940 | 1055 | 1200 | 1300 |
| Potential before cleaning | −389 | −213 | −126 | −41 | 11 | 89 | 179 | 288 | 350 |
| Adhesion level (10 revolutions) | x | x | x | x | x | x | x | ○ | ○ |
| Adhesion level (30 revolutions) | x | x | x | x | ○ | ○ | ○ | ○ | ○ |

The above results will be considered.

It is considered that, as the external additive added to the toner, there exist one whose charging polarity is the same as that of the toner (negative polarity) and one whose charging polarity is opposite to that of the toner (positive polarity).

At the time of image formation, the potential before cleaning is the same as that of the toner (negative polarity). When the polarity before cleaning is of the same polarity as the toner (negative polarity), a repulsive force is exerted between the external additive such as silica charged to the same polarity as the toner (negative polarity) and the photosensitive drum 1. Thus, if asperity is generated on the surface of the photosensitive drum 1, the external additive can be easily removed by the cleaning member.

However, an attraction is exerted between the external additive charged to the polarity opposite to that of the toner (positive polarity) and the photosensitive drum 1, so that the external additive is not easily removed by cleaning. Further, such an external additive may easily enter the interior of the contact nip between the cleaning member and the photosensitive drum 1. And, the external additive having entered the nip adheres to the photosensitive drum 1 inside the nip interior due to the pressure of the cleaning member. Thus, the external additive (adhering substance) charged to the polarity opposite to that of the toner is generated on the surface of the photosensitive drum 1 by repeating image formation.

When the potential before cleaning of the photosensitive drum 1 was experimentally set to the same polarity as the toner (negative polarity), the adhering substances on the photosensitive drum 1 were not removed. On the other hand, when the potential before cleaning of the photosensitive drum 1 is set to the polarity opposite to that of the toner (positive polarity), the adhering substances on the photosensitive drum 1 were removed, and the number of adhesion substances tended to decrease.

It is considered that the adhesion force of the adhering substances charged to positive polarity is reduced due to the polarity of the surface potential of the photosensitive drum 1, and the adhering substances were in the state to be easily removed. The degree to which the adhering substances are reduced differs according to the potential before cleaning and the number of rotations at which the photosensitive drum 1 is rotated. When the potential before cleaning is of the opposite polarity to that of the toner and of a large absolute value, a reduction in adhering substances occurs even in the case of low number of rotations. When the potential before cleaning is of the opposite polarity to that of the toner and of a small absolute value, no reduction in adhering substances occurs unless the number of rotations is increased.

In the present exemplary embodiment, the potential before cleaning is increased in the polarity opposite to that of the toner, and when it exceeds approximately 550 V, electricity remains on the photosensitive drum 1 as positive memory, involving generation of unevenness in image density at the time of the next image formation. Thus, it is desirable for the potential before cleaning to be not more than approximately 550 V.

In the present exemplary embodiment, the above results are utilized to execute a cleaning mode at a predetermined timing for the non-image-formation period. In the cleaning mode, when the potential before cleaning at the time of image formation is regarded as a predetermined polarity, the photosensitive drum 1 is charged to a polarity opposite to the predetermined polarity. The photosensitive drum 1 is caused to make one rotation or more so that the region charged to the opposite polarity may pass the blade 5. According to this arrangement, the photosensitive drum 1 passes the blade 5 in the state being charged to the opposite polarity over the entire periphery thereof. Thus, the adhering substances charged to the positive polarity is scraped off by the blade over the entire periphery of the photosensitive drum 1.

The cleaning mode is executed during the non-image-formation period when the rotation time of the photosensitive drum 1 after the execution of the previous cleaning mode has reached a predetermined value. The rotation time of the photosensitive drum 1 is stored in a storage unit included in the image forming apparatus, and is used as a determination reference for the execution of the cleaning mode.

The control of the cleaning mode is executed by a central processing unit (CPU) 60 serving as a control device. The CPU 60 compares the rotation time of the photosensitive drum 1 stored in the storage unit with a previously stored threshold value for the execution of the cleaning mode, and executes the cleaning mode when the rotation time exceeds the threshold value. The CPU 60 controls the rotation of the photosensitive drum 1 and the application of a bias to the charging roller 2 and the primary transfer device 9 to execute the cleaning mode.

Figure 3:
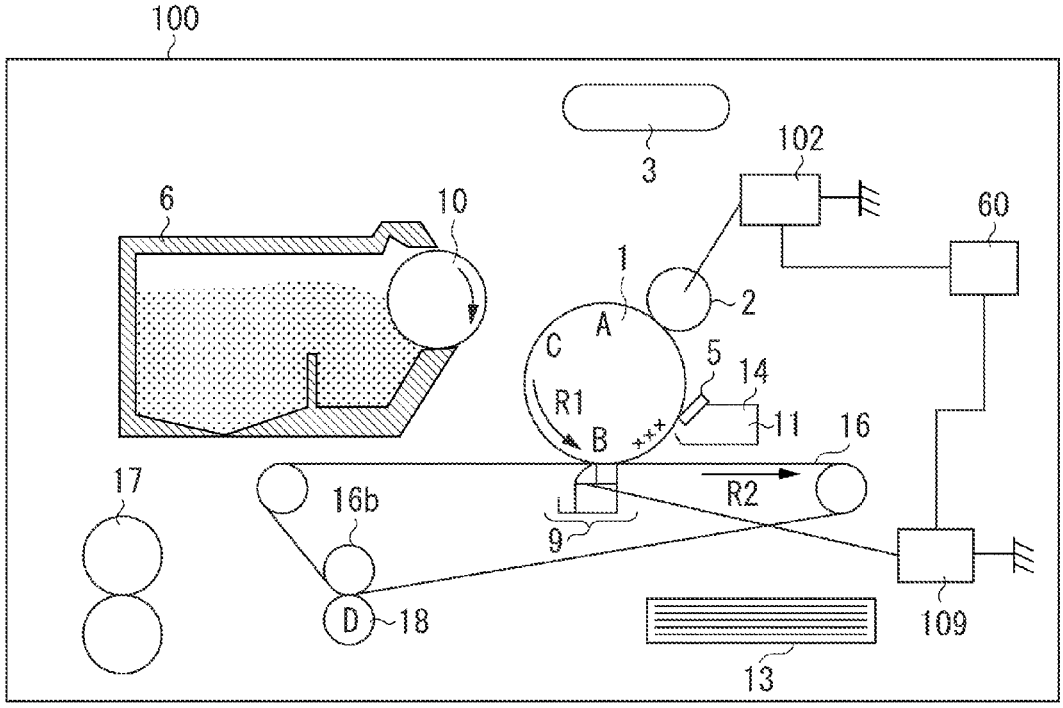
FIG. 3 is a schematic sectional view of the image forming apparatus in the cleaning mode according to the first exemplary embodiment.

As illustrated in FIG. 3, in the cleaning mode of the present exemplary embodiment, the photosensitive drum 1 is rotated 30 revolutions in the direction of an arrow R1 in a state in which the developing apparatus 6 and the photosensitive drum 1 are not in contact with each other, no laser beam is applied from the exposure apparatus, and the intermediate transfer belt 16 is brought into contact with the photosensitive drum 1 by the primary transfer device 9.

In this example, while it is described that the photosensitive drum 1 is rotated 30 times, it should be noted that the larger the number of rotations, the higher the effect of removing the adhering substances. However, when the number of rotations is larger, more time is required for the cleaning mode, and there is the possibility of the next print job being hindered. Thus, the number of rotations of the photosensitive drum 1 in the cleaning mode may be varied depending on the configuration of the apparatus to which the invention is applied and various conditions. What is important is that the photosensitive drum 1 be caused to make one rotation or more, with the requisite number of rotations being set according to the amount of adhering substances.

Table 2 shows the bias applied during the image formation and during the cleaning mode in the present exemplary embodiment and the surface potential of the photosensitive drum 1 at that time. As shown in Table 2, the charging bias is equivalent to that during the image formation, and control is performed so as to make the potential before cleaning positive by varying the primary transfer bias.

Here, control is performed such that the potential before cleaning is of the positive polarity only in the cleaning mode. In an image forming apparatus in which the photosensitive drum 1 is charge to the negative polarity, if charging is performed for a long period of time with the positive polarity on the surface potential of the photosensitive drum 1, there is the possibility of electricity remaining on the photosensitive drum 1 as positive memory to be output as unevenness in density of a next image to be formed. Thus, it is desirable for the surface potential of the photosensitive drum 1 to be of the negative polarity or set to zero, and the potential before cleaning is set to negative polarity at the time of the image formation and to be positive polarity only in the cleaning mode.

TABLE 2

| | During image formation | In cleaning mode |
|---|---|---|
| Charging bias [V] | −1100 | −1100 |
| Primary transfer bias [V] | +450 | +940 |
| Surface potential before primary transfer [V] | −530 | −530 |
| Potential before cleaning [V] | −210 | +100 |

Figure 4:
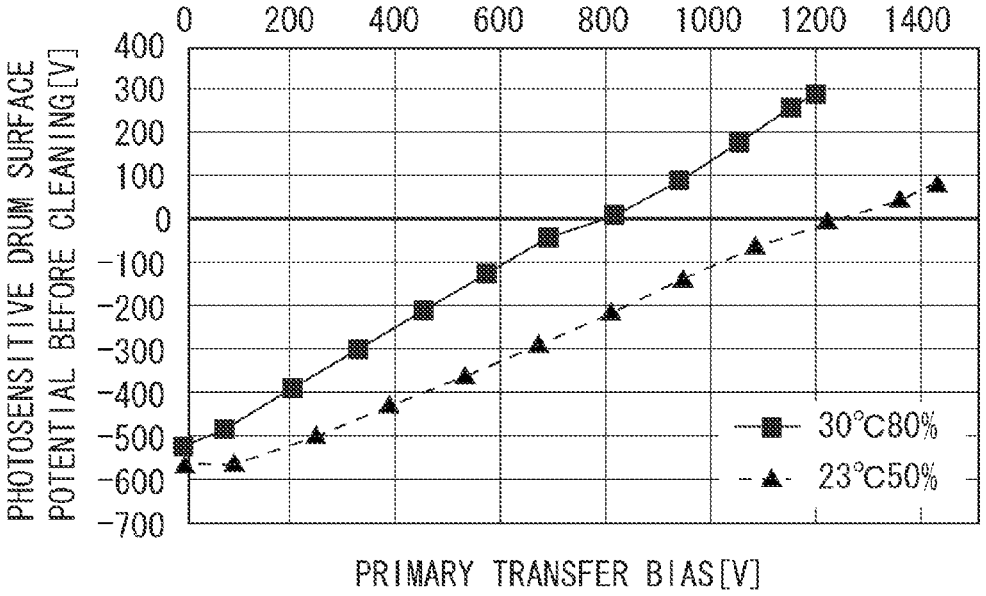
FIG. 4 illustrates the relationship between primary transfer bias and potential before cleaning in the environment of use of the first exemplary embodiment.

While specific application bias values are given in Table 2 in the present exemplary embodiment, it should be noted that, as illustrated in FIG. 4, the condition for making the potential before cleaning positive polarity differs according to the temperature and humidity environment in which the apparatus is used. FIG. 4 illustrates the relationship between the primary transfer bias and the potential before cleaning in the environment of use. As can be seen from the diagram, the resistance of the intermediate transfer belt 16 and that of the transfer sheet used in the transfer device 9 fluctuate depending on the environment of use. In view of this, in the present exemplary embodiment, the condition for making the potential before cleaning positive polarity is stored in the storage unit included in the image forming apparatus in advance according to the environment of use, and the image forming apparatus performs control according to the stored condition.

By thus periodically executing the cleaning mode, the image forming apparatus according to the present exemplary embodiment can effectively remove the adhering substances on the photosensitive drum 1, and provide a high quality print output free from defective cleaning due to the adhering substances and black dots on an image.

Figure 5:
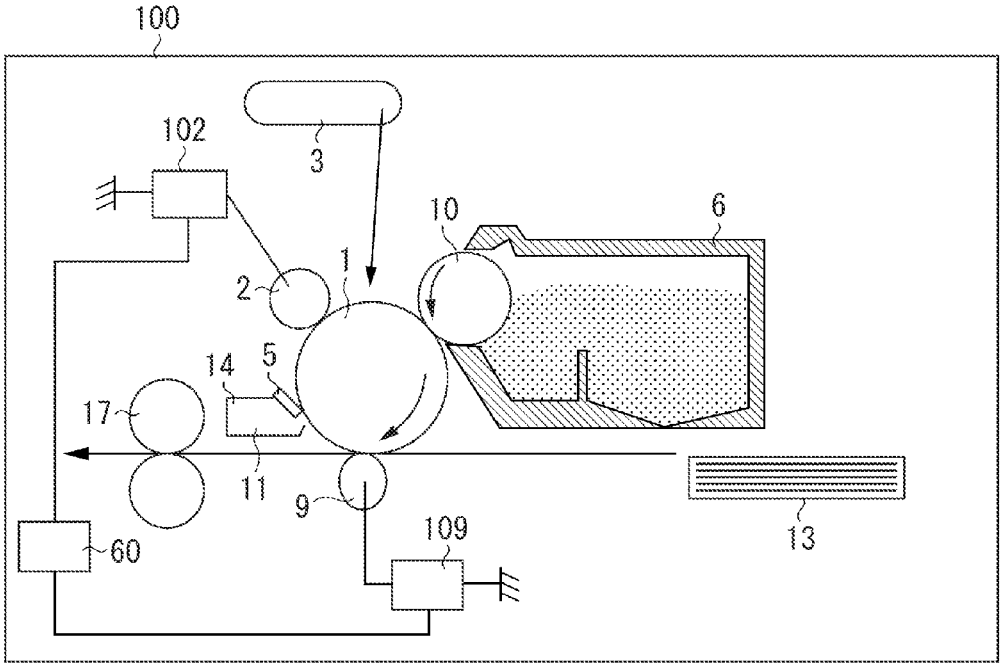
FIG. 5 is a schematic sectional view of the image forming apparatus according to the first exemplary embodiment to which the present invention is applicable.

In the present exemplary embodiment described above, a transfer sheet is adopted to the transfer device 9 serving as the primary transfer apparatus. Apart from this, it is also possible to adopt a configuration in which the transfer roller is brought into contact with the intermediate transfer belt, and is applied a voltage. Instead of using an intermediate transfer belt, it is also possible, as illustrated in FIG. 5, to adopt a configuration in which the transfer material 13 such as a sheet directly moves between the toner image formed on the photosensitive drum 1 and the transfer roller to transfer the toner image thereto. In this case, the sheet is a member to be transferred.

While in the first exemplary embodiment described above the potential before cleaning at the time of the image formation is of negative polarity, the present invention is also applicable to a case in which the potential before cleaning at the time of the image formation is of positive polarity. In this case, in the cleaning mode, the potential before cleaning is of negative polarity.

The present inventors conducted an examination with a view toward further enhancing the effect of the cleaning mode described above. In particular, the present inventors have found out that, depending on the configuration of the cleaning apparatus, it is important to discharge the developer from the developing apparatus 6 onto the photosensitive drum 1 and to supply it to the blade 5 before the execution of the cleaning mode.

The reason for this will be discussed below.

As described above, the adhering substances charged to the positive polarity are removed by executing the cleaning mode. However, if there is any toner accommodated in the waste toner chamber of the cleaning apparatus at the time of execution of the cleaning mode, the toner may supply the released external additive to the photosensitive drum 1. The toner accommodated in the waste toner chamber 14 is the transfer residual toner that has not undergone primary transfer or re-transfer toner which is transferred from the intermediate transfer belt 16 to the photosensitive drum 1 again (hereinafter, this will be referred to as the "waste toner").

The transfer residual toner and the re-transfer toner are under the influence of the primary transfer, and contain a larger amount of the released external additive as compared with the toner in the developing apparatus 6. Thus, while it is a small amount, the waste toner may supply the external additive to the blade 5. Such supply of the external additive occurs to a marked degree when the transfer residual toner or the like in the waste toner chamber is accommodated so as to be in contact with the surface of the photosensitive drum 1.

Thus, the effect of scraping off the adhering substances can be enhanced by executing the cleaning mode with such supply of waste toner eliminated.

In the present exemplary embodiment, before the execution of the cleaning mode, the toner is supplied to the cleaning blade 5 from the developing apparatus 6, whereby the toner is sent into a gap between the waste toner and the photosensitive drum 1. The toner thus supplied from the developing apparatus 6 will be referred to as the supply toner.

Development of the supply toner is intentionally performed with respect to the photosensitive drum 1, and a negative bias different from that for the image formation is applied for the primary transfer to cause the cleaning blade 5 to recover the toner without primary transfer. At this time, the primary transfer device may be spaced apart by a separation mechanism.

Then, the supply toner enters the gap between the waste toner and the photosensitive drum 1, and the waste toner being in contact with the surface of the photosensitive drum is replaced by the supply toner.

Figure 8A:
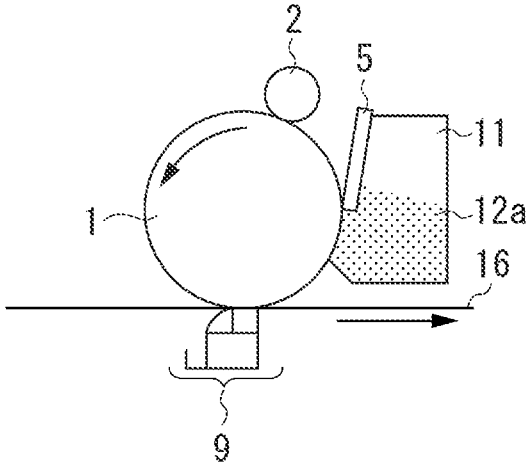
FIG. 8A illustrates the condition of a photosensitive drum and waste toner.
Figure 8B:
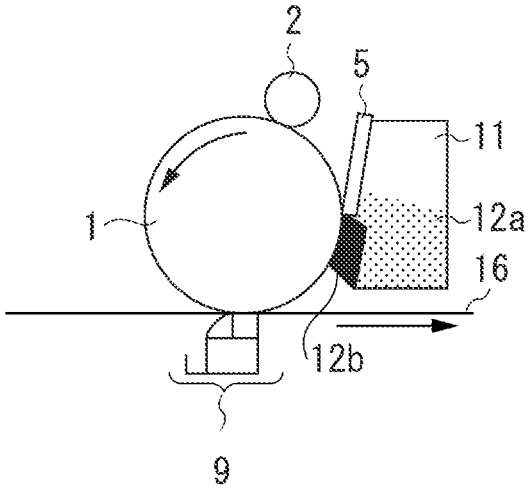
FIG. 8B illustrates the condition of the photosensitive drum and supply toner.

FIGS. 8A and 8B illustrate the state of the photosensitive drum 1 and the waste toner 12*a* at the time of the replacement. FIG. 8A illustrates the state of the photosensitive drum 1 and the waste toner 12*a* (gray portion) before the supply of the supply toner. The photosensitive drum 1 and the waste toner 12*a* are constantly brought into contact with each other. Here, as illustrated in FIG. 8B, the supply of the supply toner may cause transition from the state in which the waste toner 12*a* covers the surface of the photosensitive drum 1 to the state in which the supply toner 12*b* (black portion) covers the same. The supply toner also enters the nip portion between the cleaning blade 5 and the photosensitive drum 1. Accordingly, it is possible to cut off the influence of the waste toner.

Compared to the waste toner, the supply toner is low in released external additive content. Thus, as compared with the state in which the waste toner is in contact with the surface of the photosensitive drum 1, it is more desirable to supply the supply toner to bring it into contact with the surface of the photosensitive drum 1 since that will help to suppress occurrence of adhesion of the released external additive.

Further, by executing the cleaning mode with the supply toner being in contact with the surface of the photosensitive drum 1, a further enhanced effect of removing the adhering substances can be expected.

In effect, the following examinations were conducted using the photosensitive drum 1 in the later stage of its service life and the cleaning apparatus 11.

Comparison was made, through image defect check and observation of the photosensitive drum 1, between a case where the cleaning mode is executed with no supply toner and the waste toner being brought into contact with the photosensitive drum, and a case where the cleaning mode is executed after feeding the supply toner.

The number of adhering substances on the photosensitive drum 1 were substantially equivalent to the both cases and the charging bias and the primary transfer bias were applied thereto. In this state, the photosensitive drum 1 was rotated 30 revolutions, and then generation of defective cleaning and an image defect such as black dots on the image and the adhesion level on the photosensitive drum 1 were checked in respective cases.

The supply toner amount was 222 mm (in the longitudinal direction)*5 mm (in the peripheral direction).

When the cleaning mode was executed with no supply toner and the photosensitive drum 1 was rotated 30 revolutions, generation of the image defect was suppressed, and reduction in the adhering substances on the surface of the photosensitive drum 1 was observed.

On the other hand, when the cleaning mode was executed after feeding the supply toner, an equivalent effect was observed after 20 revolutions of the photosensitive drum 1.

Thus, by feeding the supply toner, it was possible to further enhance the cleaning performance on the surface of the photosensitive drum and to promote the adhering substance removing effect.

The effect of the cleaning mode also depends on the amount of supply toner. The larger the amount of supply toner, the larger the amount of toner sent into the gap between the surface of the photosensitive drum 1 and the waste toner, so that it is possible to prevent the released external additive from coming into contact with the surface.

In effect, the amount of the supply toner was set to ten times that of the above examination, and a similar examination was conducted. As a result, the number of rotations was still less than that of the above results, and the similar effect was observed after 10 revolutions.

An increase in the amount of the supply toner helps to promote the effect of the cleaning mode. However, it involves delivery of the toner that can be used for development otherwise, which means the service life of the photosensitive drum has to be taken into account when determining the amount of the supply toner.

An image forming apparatus 100 according to a second exemplary embodiment of the present invention will be described with reference to FIG. 6. Since its basic configuration is the same as that of the first exemplary embodiment, the following description will center on the features of the present exemplary embodiment.

While in the first exemplary embodiment described above the cleaning mode is executed periodically, it should be noted that the more frequently the cleaning mode is executed, the higher the effect of suppressing generation of adhering substances. Further, as described in the first exemplary embodiment, the larger the number of rotations of the photosensitive drum 1 at the time of execution of the cleaning mode, the higher the effect of removing the adhering substances.

However, regardless of which of the frequency of execution of the cleaning mode and the number of rotations of the photosensitive drum 1 is increased, the possibility of the next print job being hindered increases.

Thus, if the situation in which adhering substances are likely to be generated is expected, the frequency of execution of the cleaning mode and the number of rotations of the photosensitive drum 1 may be varied according to the situation.

As described above, when the surface of the photosensitive drum 1 is charged for a long period of time to a positive polarity that is opposite to the charging polarity at the time of image formation, electricity remains on the photosensitive drum 1 as positive memory, which may be output as unevenness in density of a next image to be formed. If, as in the present exemplary embodiment, the cleaning mode is executed whenever necessary by an amount desired, it is possible to reduce the risk of the photosensitive drum 1 generating positive memory to cause an image defect.

In the present exemplary embodiment, the frequency of execution of the cleaning mode can be varied according to the environment of use. In an environment of high temperature and high humidity, the amount of external additive released from the toner surface increases. Thus, adhering substances on the photosensitive drum 1 are likely to be generated in the environment of high temperature and high humidity. Accordingly, the higher the temperature and humidity of the environment, the higher the frequency of execution of the cleaning mode is set. Whereas, the lower the temperature and humidity of the environment, the lower the risk of generation of adhering substances, thus the frequency of execution of the cleaning mode can be set lower.

The cleaning mode is executed during the non-image-formation period after the rotation time of the photosensitive drum 1 has reached a predetermined value after the execution of the previous cleaning mode. The rotation time of the photosensitive drum 1 is stored in the storage unit included in the image forming apparatus, and is used as a determination reference for the execution of the cleaning mode.

Figure 6:
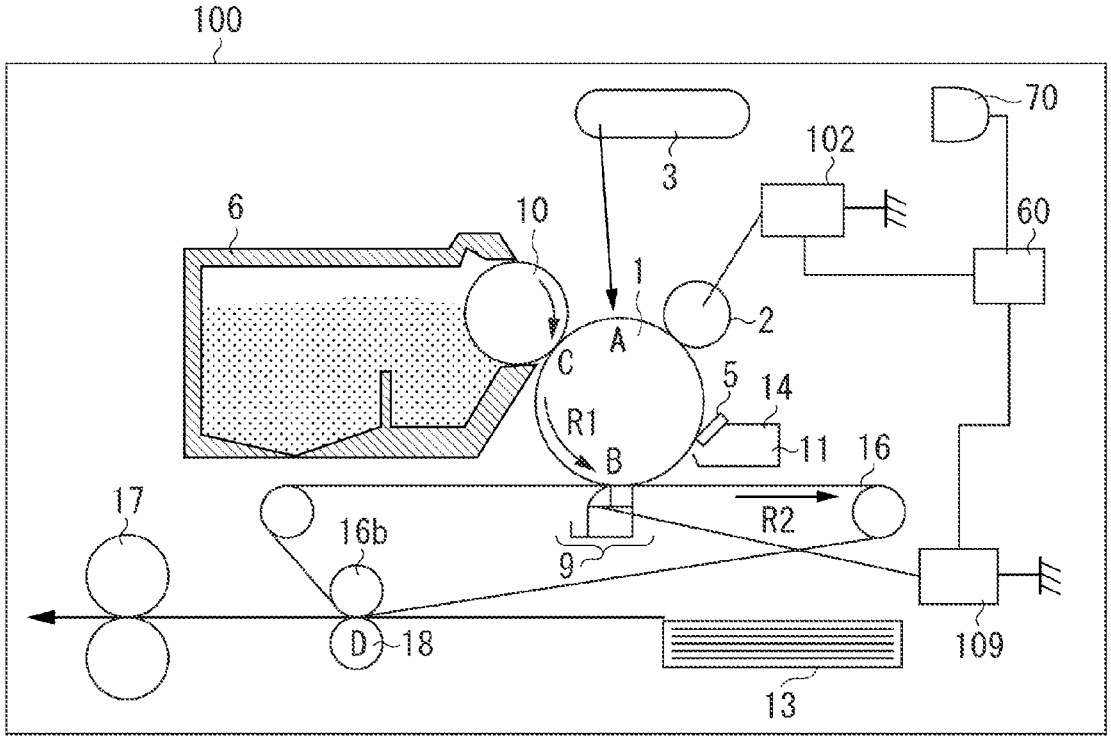
FIG. 6 is a schematic sectional view of an image forming apparatus according to a second exemplary embodiment to which the present invention is applicable.

As illustrated in FIG. 6, the image forming apparatus according to the present exemplary embodiment includes a temperature detection unit 70 (an environment detection device). As shown in Table 3, whether to execute the cleaning mode or not is defined according to the detection result of the temperature detection unit 70, and in the case where it is executed, an execution threshold value is stored in the storage unit.

If an ambient temperature is at which the cleaning mode is to be executed, the cleaning mode is executed by the CPU 60 serving as the control apparatus. The CPU 60 compares the rotation time of the photosensitive drum 1 stored in the storage unit with a previously stored execution threshold value, executing the cleaning mode when the rotation time exceeds the threshold value. The CPU 60 controls the rotation of the photosensitive drum 1 and the application of a bias to the charging roller 2 and the primary transfer device 9 to execute the cleaning mode.

TABLE 3

| | Ambient temperature (° C.) | | |
|---|---|---|---|
| | T < 15° C. | 15° C. ≤ T < 30° C. | 30° C. ≤ T |
| Cleaning mode | Not executed | Executed | Executed |
| Execution threshold value (sec) | — | 600 | 300 |
| number of rotations of the drum | — | 30 | 30 |

While in the present exemplary embodiment the temperature is taken into account, it is also possible to take both temperature and humidity into account or to take into account humidity only. For example, it may be arranged such that the higher the humidity, the higher the frequency of execution, and, the lower the humidity, the lower the frequency of execution.

Further, while in the present exemplary embodiment, the execution threshold value is varied according to the ambient temperature, it is also possible to vary the number of rotations of the drum, effecting control as shown, for example, in Table 4.

TABLE 4

| | Ambient temperature (° C.) | | |
|---|---|---|---|
| | T < 15° C. | 15° C. ≤ T < 30° C. | 30° C. ≤ T |
| Cleaning mode | Not executed | Executed | Executed |
| Execution threshold value (sec) | — | 600 | 300 |
| number of rotations of the drum | — | 60 | 30 |

As described above, it is determined whether the image forming apparatus is in a low temperature (low humidity) environment (i.e., a first environment) or a high temperature (high humidity) environment (i.e., a second environment) to vary the frequency of execution of the cleaning mode. Alternatively, the number of rotations of the drum in the cleaning mode can be varied.

In other words, control is performed such that the frequency of execution of the cleaning mode is higher in the high temperature (high humidity) environment than in the low temperature (low humidity) environment.

Further, in other words, control is performed such that the number of rotations of the photosensitive drum rotated in the cleaning mode is larger in the high temperature (high humidity) environment than in the low temperature (low humidity) environment.

Further, it is possible to combine the control of the frequency of execution with the control of the number of rotations of the photosensitive drum.

Further, as described in the first exemplary embodiment, if the supply toner is supplied to the blade 5 before the cleaning mode, it is possible to enhance the efficiency in cleaning.

An image forming apparatus 100 according to a third exemplary embodiment of the present invention will be described with reference to FIG. 7. In the second exemplary embodiment, the frequency of execution of the cleaning mode is varied since the frequency of generation of adhering substances varies depending on the environment of use. In the image forming apparatus of the present exemplary embodiment, there is adopted a configuration in which the developing apparatus 6 is detachable to the image forming apparatus main body. The image forming apparatus main body refers to the portion of the image forming apparatus 100 other than the developing apparatus 6.

If the replaceable developing apparatus 6 is adopted and when the developing apparatus 6 is replaced by a new one in the state that asperity due to worn flaws on the surface of the photosensitive drum 1, adhering substances are likely to be generated during an initial operation (e.g., toner agitating operation) of the developing apparatus since the new toner contains more released external additives. Thus, the cleaning mode is executed after the initial operation and before the image formation.

As described above, when the surface of the photosensitive drum 1 is charged for a long period of time to a positive polarity that is opposite to the charging polarity at the time of image formation, electricity remains on the photosensitive drum 1 as positive memory, which may be output as unevenness in density of a next image to be formed. In the present exemplary embodiment, the cleaning mode is executed only when it is necessary, whereby it is possible to reduce the risk of the photosensitive drum 1 generating positive memory to cause an image defect.

Basically, the cleaning mode is executed periodical timing for each rotation time of the photosensitive drum 1. In view of this, when the insertion of the new developing apparatus 6 is detected by a developing device use situation detection unit 80, the cleaning mode is executed immediately despite the periodical timing. In other words, the cleaning mode is executed prior to the start of the image formation. As a result, any adhering substances generated due to the external additive during the initial operation of a new developing apparatus can be effectively removed.

Further, as described in the first exemplary embodiment, if the supply toner is supplied to the blade 5 before the cleaning mode, it is possible to enhance the efficiency in cleaning.

An image forming apparatus 100 according to a fourth exemplary embodiment of the present invention will be described with reference to FIG. 7.

In the third exemplary embodiment described above, it is illustrated when the cleaning mode is executed prior to the start of the image formation upon replacement of the developing apparatus 6 for a new one. However, a new developing apparatus involves a relatively large amount of released external additive, so that it is possible to vary the frequency of execution of the cleaning mode and the number of rotations of the photosensitive drum 1 according to the used amount of the developing apparatus.

In the present exemplary embodiment, if a new developing apparatus is used only little, there is a high possibility of released external additive existing in the developing apparatus 6, so that, as compared with the case where the developing apparatus has been used much, the frequency of execution of the cleaning mode and the number of rotations of the photosensitive drum 1 are increased.

As described above, when the surface of the photosensitive drum 1 is charged for a long period of time to a positive polarity that is opposite to the charging polarity at the time of image formation, electricity remains on the photosensitive drum 1 as positive memory, which may be output as unevenness in density of a next image to be formed. In the present exemplary embodiment, the cleaning mode is executed only when it is necessary, so that it is possible to reduce the risk of the photosensitive drum 1 generating positive memory to cause an image defect.

Figure 7:
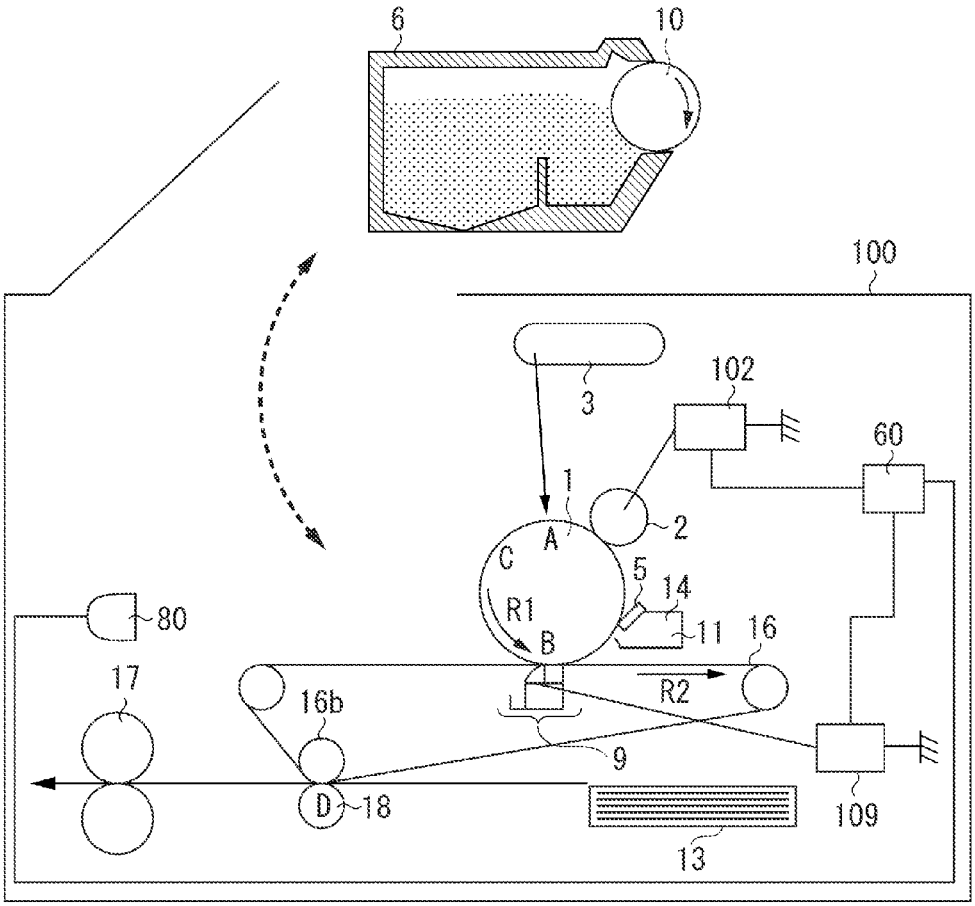
FIG. 7 is a schematic sectional view of an image forming apparatus according to third and fourth exemplary embodiments to which the present invention is applicable.

As illustrated in FIG. 7, the image forming apparatus 100 according to the present exemplary embodiment includes a developing apparatus use situation detection unit 80 (determination device). The image formation time is employed as the used amount of the developing apparatus. For example, the image formation time since the replacement of the developing apparatus by a new one is stored in the storage unit (memory tag) provided in the developing apparatus. Then, the cleaning mode is controlled based on the image formation time stored in the memory tag.

Regarding the timing to execute the cleaning mode, as shown in Table 5, an execution threshold value for the cleaning mode is stored in the storage unit according to the image formation time detected by the developing apparatus use situation detection unit 80.

The cleaning mode is executed by the CPU 60 serving as the control apparatus. The CPU 60 compares the rotation time of the photosensitive drum 1 since the execution of the previous cleaning mode with a previously stored execution threshold value, and executes the cleaning mode when the rotation time exceeds the threshold value. The CPU 60 controls the rotation of the photosensitive drum 1, the application of bias to the charging roller 2, and the primary transfer device 9, and executes the cleaning mode.

TABLE 5

| | Image formation time X (sec) | |
|---|---|---|
| | X < 600 | 600 ≤ X |
| Execution threshold value (sec) | 100 | 300 |
| number of rotations of the drum | 30 | 30 |

Execution Threshold Value Drum Number of Rotations

While in the present exemplary embodiment the execution threshold value is varied according to the ambient temperature, it is also possible to vary the number of rotations of the drum, which is controlled as shown in Table 6, for example.

TABLE 6

| | Image formation time X (sec) | |
|---|---|---|
| | X < 600 | 600 ≤ X |
| Execution threshold value (sec) | 300 | 300 |
| number of rotations of the drum | 90 | 30 |

As described above, it is determined whether an amount of use (first amount of use) of the developing apparatus is small, and whether another amount of use (second amount of use) of the developing device is larger than the first amount of use to change the frequency of execution of the cleaning mode, or change the number of rotations of the photosensitive drum rotated in the cleaning mode.

In other words, control is performed such that the frequency of execution of the cleaning mode is lower when the amount of use of the developing apparatus is large than when the amount of use of the developing apparatus is small.

In other words, control is performed such that the number of rotations of the photosensitive drum rotated in the cleaning mode is smaller when the amount of use of the developing apparatus is large than when the amount of use of the developing apparatus is small.

Further, it is also possible to combine the control of the frequency of execution with the control of the number of rotations of the photosensitive drum.

Further, as described in the first exemplary embodiment, if the supply toner is supplied to the blade 5 before the cleaning mode, it is possible to enhance the efficiency in cleaning.

Figure 9:
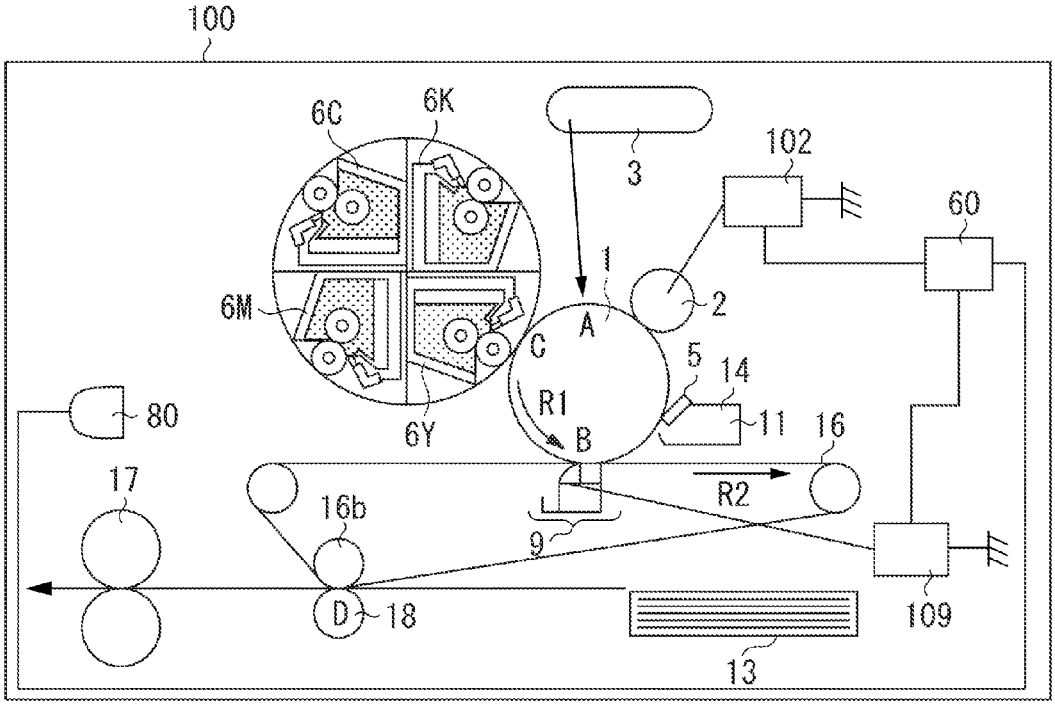
FIG. 9 is a schematic sectional view of an image forming apparatus according to a fifth exemplary embodiment to which the present invention is applicable.

FIG. 9 illustrates a full color image forming apparatus according to a fifth exemplary embodiment. The image forming apparatus is equipped with developing apparatuses (developing units) 6Y (yellow), 6M (magenta), 6C (cyan), and 6K (black). The developing apparatuses 6Y, 6M, 6C, and 6K are provided so as to be detachable from the image forming apparatus main body. The image forming apparatus main body refers to the portion of the image forming apparatus 100 other than the developing apparatuses 6Y to 6K.

Otherwise, the image forming apparatus according to the present exemplary embodiment has the same configuration as the fourth exemplary embodiment. Thus, the following description will center on the feature of the present exemplary embodiment.

In the case where the replaceable developing apparatuses 6 are adopted, the release state of the external additive from the toner in each developing apparatus varies greatly depending on the usage state of the developing apparatus. If a developing apparatus in the initial stage of use, i.e., in the case of new toner, a large amount of released external additive is included therein. As described in the first exemplary embodiment, if the waste toner contains a large amount of released external additive, the external additive is likely to adhere to the surface of the photosensitive drum 1. Thus, in the case where there is a plurality of developing apparatuses, the cleaning effect is higher when the developing apparatus in which the external additive is released to a small degree is selected, and the supply toner is supplied to the blade 5.

In the present exemplary embodiment, the CPU obtains information about the release state of the external additive from the toner accommodated in the developing apparatus to select the developing apparatus in which the degree of release of the external additive is the least. The supply toner is supplied to the blade 5 before the cleaning mode from the selected developing apparatus. The information about the release state of the external additive may include the number of rotations of the development roller 10, the rotation time thereof, and the residual toner amount in the developing apparatus. The information about the release state of the external additive is determined by the developing apparatus use situation detection unit 80 provided in the image forming apparatus 100. For example, the number of rotations of the development roller 10 since the replacement of the developing apparatus by a new one is stored in the storage unit (memory tag) provided in the developing apparatus. Then, the developing apparatus is selected based on the information stored in the memory tag.

It is assumed that the larger the number of rotations of the development roller 10 and the rotation time, the less the external additive is released. In view of this, when selecting the developing apparatus, the CPU selects the developing apparatus in which the number of rotations of the development roller 10 and the rotation time are maximum, and supplies the supply toner to the blade 5. Further, it is assumed that the smaller the residual toner amount in the developing apparatus, the less the external additive is released. In view of this, when selecting the developing apparatus, the CPU selects the developing apparatus in which the residual amount of developer is minimum, and supplies the supply toner to the blade 5. The number of rotations of the development roller 10, the rotation time thereof, and the residual amount of developer is detected by a conventionally known detection method, and the information thus obtained is stored in the storage unit provided in the image forming apparatus.

While in the first through fourth exemplary embodiments the primary transfer device 9 is used as the member for forming the potential before cleaning in the cleaning mode, this should not be construed restrictively. For example, it is also possible to vary the bias applied to the charging roller 2 to control the potential before cleaning in the cleaning mode. Further, it is also possible to control the potential of the photosensitive drum 1 by a member other than the charging roller 2 and the transfer device 9.

While in the first through fourth exemplary embodiments described above a reversal development type image forming apparatus is adopted, this should not be construed restrictively. For example, the present invention is also applicable to a normal development type apparatus in which the charging polarity of the photosensitive drum and the charging polarity of the toner at the time of image formation are opposite to each other.

While in the first through fourth exemplary embodiments described above a monochrome image forming apparatus is adopted, the present invention is also applicable to a full color image forming apparatus.

Further, it is also possible to execute the cleaning mode by combining the control methods of the second through fourth exemplary embodiments with each other.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Applications No. 2010-185090 filed Aug. 20, 2010 and No. 2010-185294 filed Aug. 20, 2010, which are hereby incorporated by reference herein in their entirety.

What is claimed is:

1. An image forming apparatus comprising:

an image bearing member configured to be rotatable and to bear a latent image;

a developing apparatus configured to develop the latent image into a toner image by using a toner containing an external additive;

a transfer apparatus configured to transfer the toner image to a member to be transferred;

a cleaning apparatus configured to perform cleaning of the toner from the image bearing member after transfer; and a control apparatus configured to electrically charge the image bearing member to a predetermined polarity during an image-formation period, and electrically charge the image bearing member to a polarity opposite the predetermined polarity during a non-image-formation period, and to execute a cleaning mode in which the image bearing member is rotated one rotation or more in a non-contact state with the developing apparatus so that a surface of the image bearing member charged to the opposite polarity, may pass the cleaning apparatus to remove the external additive on the surface of the image bearing member.

2. The image forming apparatus according to claim 1, wherein the toner is supplied to the cleaning apparatus from the developing apparatus in the non-image-formation period before execution of the cleaning mode.

3. The image forming apparatus according to claim 2, wherein the toner is supplied to the cleaning apparatus from a yellow developing apparatus.

4. The image forming apparatus according to claim 2, wherein the developing apparatus is equipped with a plurality of developing units accommodating toners of different colors, the control apparatus obtains information about a release state of the external additive from the toner accommodated in the developing unit, and before the execution of the cleaning mode, the toner is supplied to the cleaning apparatus from the developing units in which release of the external additive from the toner accommodated in the developing unit is a minimum among the plurality of developing units.

5. The image forming apparatus according to claim 4, wherein the information about the release state of the external additive from the toner accommodated in the developing unit includes a rotation time or the number of rotations of a development roller provided in the developing unit.

6. The image forming apparatus according to claim 4, wherein the information about the release state of the external additive from the toner accommodated in the developing unit includes a residual amount of the toner accommodated in the developing unit.

7. The image forming apparatus according to claim 1, wherein, in the cleaning mode, the image bearing member is charged by the transfer device to a polarity opposite to the predetermined polarity.

8. The image forming apparatus according to claim 1, further comprising an environment detection apparatus configured to detect temperature or humidity, wherein the control apparatus sets a first environment and a second environment which is of higher temperature or higher humidity than the first environment, and performs control according to the detected temperature or humidity such that a frequency of the execution of the cleaning mode is higher in the second environment than in the first environment.

9. The image forming apparatus according to claim 1, further comprising an environment detection apparatus configured to detect temperature or humidity, wherein the control apparatus sets a first environment and a second environment which is of higher temperature or higher humidity than the first environment, and performs control according to the detected temperature or humidity such that the number of rotations of the image bearing member to be rotated in the cleaning mode is higher in the second environment than in the first environment.

10. The image forming apparatus according to claim 1, wherein the developing apparatus is provided so as to be detachable from a main body of the image forming apparatus, the image forming apparatus further comprising a determination apparatus configured to determine whether the developing apparatus is a new one or not, wherein if the determination apparatus determines that the developing apparatus is a new one, the cleaning mode is executed before image formation is started.

11. The image forming apparatus according to claim 1, further comprising a determination apparatus configured to determine a usage amount of the developing apparatus, wherein the control apparatus sets a first usage amount and a second usage amount which is larger than the first usage amount as the usage amount of the developing apparatus, and performs control according to the determined usage amount such that a frequency of the execution of the cleaning mode is lower in the case of the second usage amount than in the case of the first usage amount.

12. The image forming apparatus according to claim 1, further comprising a determination apparatus configured to determine a usage amount of the developing apparatus, wherein the control apparatus sets a first usage amount and a second usage amount which is larger than the first usage amount as the usage amount of the developing apparatus, and performs control according to the determined usage amount such that the number of rotations of the image bearing member to be rotated in the cleaning mode is less in the case of the second usage amount than in the case of the first usage amount.

13. The image forming apparatus according to claim 1, wherein the image bearing member is situated on an upstream side, in a rotational direction of the image bearing member, with respect to the cleaning apparatus.

* * * * *